United States Patent [19]

Reavis et al.

[11] Patent Number: 4,463,998

[45] Date of Patent: Aug. 7, 1984

[54] CONNECTOR ASSEMBLY FOR UNDERCARPET CABLE

[75] Inventors: Robert P. Reavis, Statesville; Mickey L. Mayberry, Winston-Salem; David Willette, Pfafftown; Lawrence P. Weisenburger; Reginald A. Bates, both of Kernersville, all of N.C.

[73] Assignee: AMP Incorporated, Harrisburg, Pa.

[21] Appl. No.: 536,593

[22] Filed: Sep. 28, 1983

Related U.S. Application Data

[63] Continuation of Ser. No. 354,839, Mar. 4, 1982, abandoned.

[51] Int. Cl.[3] ..... H01R 13/447

[52] U.S. Cl. ..... 339/40; 339/97 P; 339/122 R; 339/123

[58] Field of Search ..... 339/17 F, 36, 40, 97 R, 339/97 P, 98, 99, 176 MF, 122–125; 174/48

[56] References Cited

U.S. PATENT DOCUMENTS

| | | | |
|---|---|---|---|
| 3,860,319 | 1/1975 | Slater | 339/99 R |
| 3,860,739 | 1/1975 | Kloth et al. | 339/99 R |
| 4,240,688 | 12/1980 | Sotolongo | 339/122 F |
| 4,257,659 | 3/1981 | Gibbs | 339/40 |
| 4,270,833 | 6/1981 | Storck | 339/121 |
| 4,279,457 | 7/1981 | Nickence | 339/40 |
| 4,289,370 | 9/1981 | Storck | 339/125 R |

*Primary Examiner*—John McQuade
*Assistant Examiner*—Paula Austin
*Attorney, Agent, or Firm*—Robert W. J. Usher; F. Brice Faller

[57] ABSTRACT

An electrical connector for undercarpet flat, flexible cable includes a metal plate having plural lands raised in relief, a terminal block constructed to overlie selected lands and a fastener carried by the block to secure in one of the overlaid lands and apply the block and the overlaid lands in clamped relationship on a flat flexible cable, terminals in the terminal block are urged by the block to penetrate into the cable conductors to establish electrical connections.

4 Claims, 8 Drawing Figures

CONNECTOR ASSEMBLY FOR UNDERCARPET CABLE

This application is a continuation of application Ser. No. 354,839 filed Mar. 4, 1982, now abandoned.

There is disclosed in U.S. Pat. No. 4,240,688, a floor fixture for flat undercarpet cable. A terminal block carries electrical terminals that penetrate conductors of the cable. The fixture requires a duplex receptacle, i.e. electrical receptacle connector with two receptacles for receipt of electrical plugs of the type provided on the electrical cord of a household appliance or office machine. Insulated wires are then installed to connect the terminals of the terminal block with the duplex receptacle. A housing is assembled over the terminal block and duplex receptacle.

The present invention resides in an electrical connector assembly in which a terminal block also is an electrical receptacle for an electrical plug. The terminal block is connected electrically to the conductors of an undercarpet cable simply upon assembly of the terminal block to a metal plate, clamping therebetween the cable conductors. A cover plate is then installed over the terminal block and secured to the plate. The present invention results in fewer parts than the previously disclosed floor fixture and is assembled more quickly and readily. The metal plate is stamped and formed with projecting lands raised in relief, providing stiffeners for the plate and grips for gripping the cable. The raised lands also ensure that machine screw type fasteners for the block and cover threadably extend through the full thickness of the plate.

The invention further comprises a planar metal plate having plural lands raised in relief, an insulative terminal block constructed to overlie selected lands and clamp the conductors of an undercarpet flat and flexible cable.

A better understanding of the invention is obtained by way of example from the following detailed description and accompanying drawings, in which.

Figure 1:
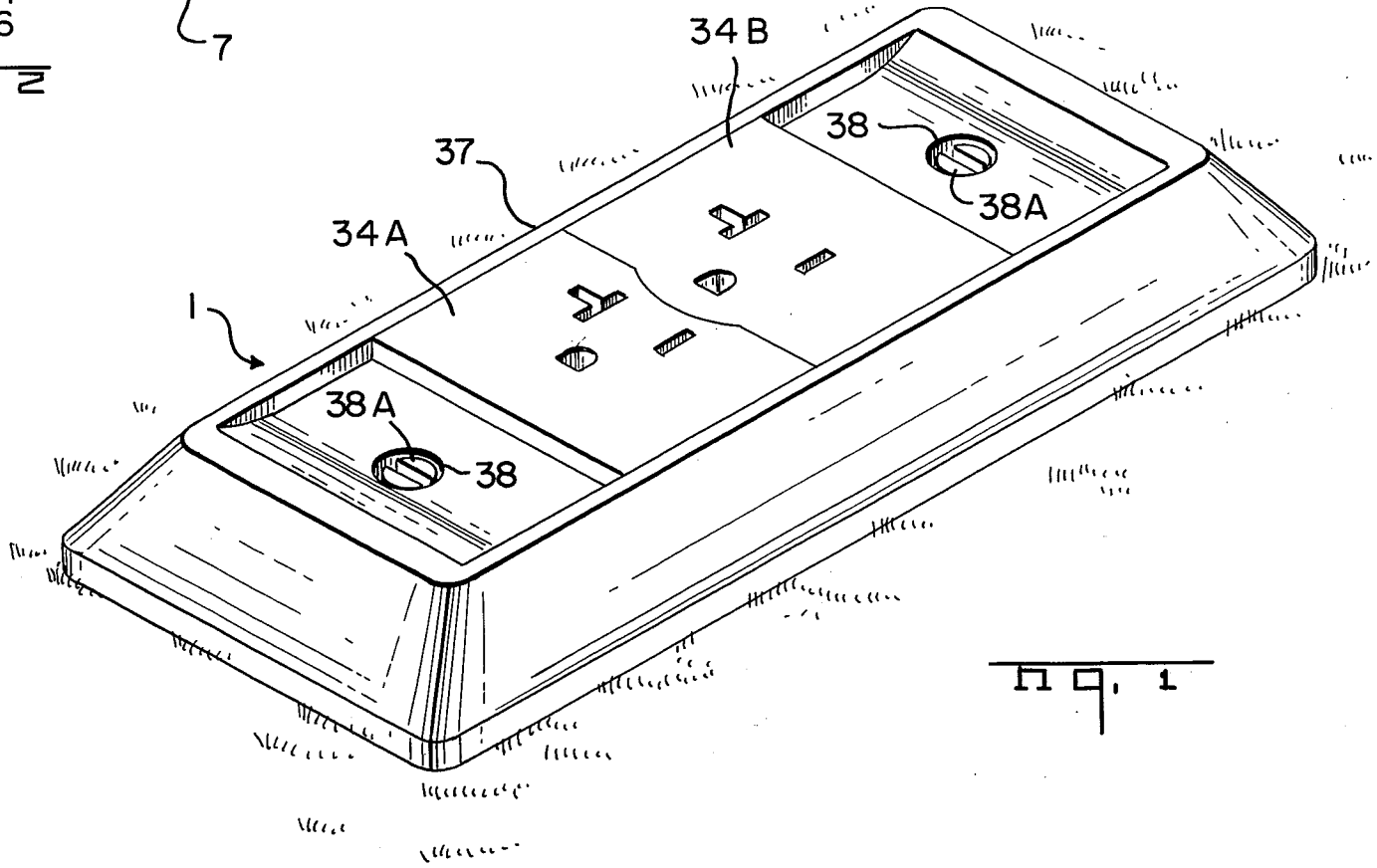
FIG. 1 is a perspective view of an electrical connector assembly for undercarpet cable.
Figure 2:
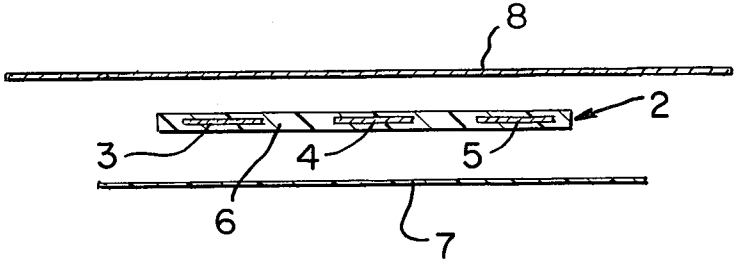
FIG. 2 is a section view of an undercarpet cable.

FIG. 1 shows an electrical connector assembly 1 for attachment to an undercarpet flat, flexible cable 2 shown in FIG. 2. The cable 2 includes three flexible elongated conductors 3, 4, 5, held parallel and spaced apart by a surrounding sheath 6 of plastics material insulation. A commercial office is supplied with electrical wiring by a network of the cable 2 that is routed along the floor of the office. The cable is laid over a flexible ribbon layer of plastic shield 7 that is laid against the office floor to protect the cable 2 from damage by floor irregularities. The cable 2 is covered by a ribbon layer of metal shield 8 which protects the cable from foot traffic and furniture. Carpeting is installed to cover the office floor. The network of cable 2 is protected by the layers of shield 7, 8 and is hidden under the carpeting; thus, the cable 2 came to be known as undercarpet cable.

Figure 3:
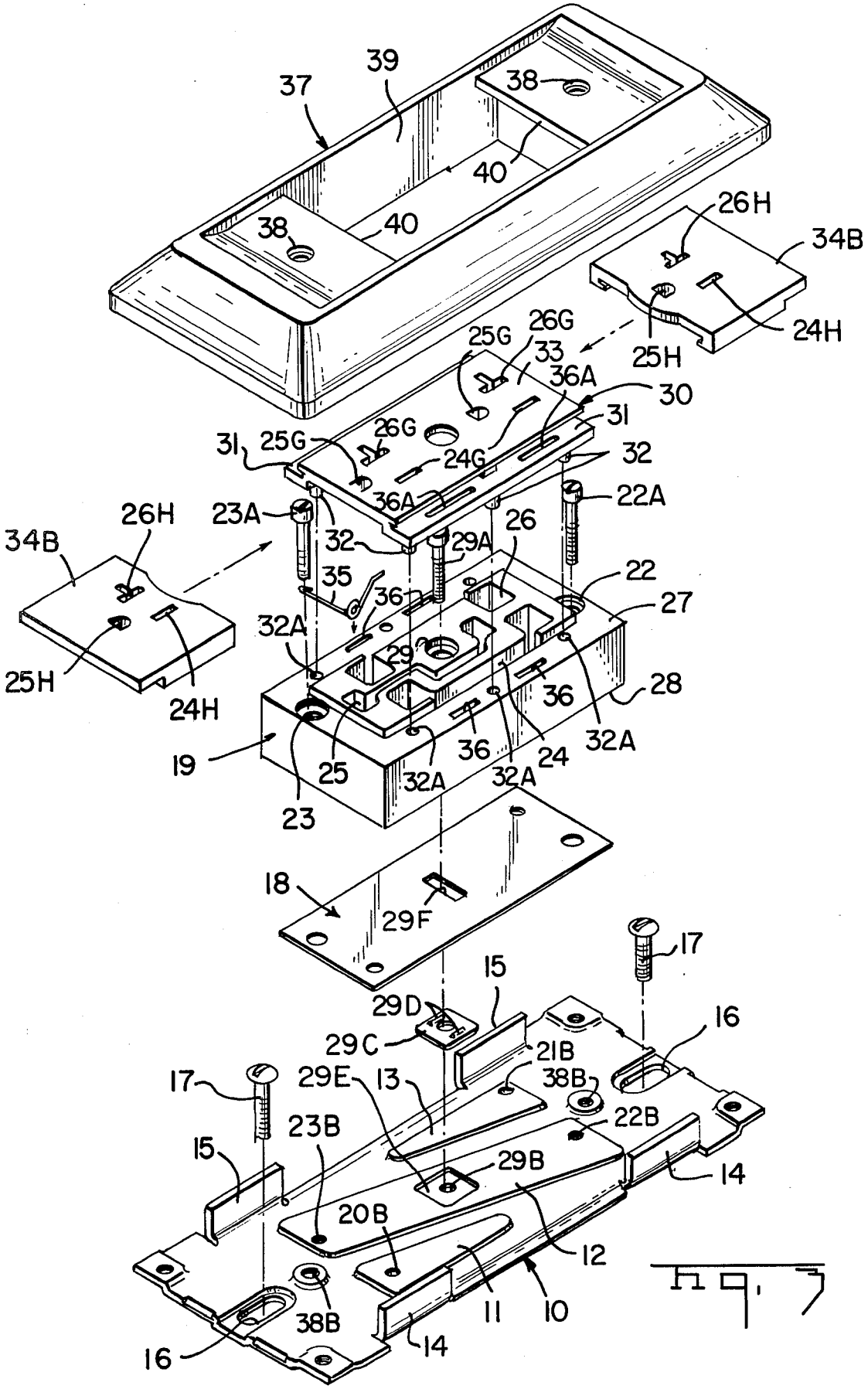
FIG. 3 is a perspective view of the electrical connector assembly according to FIG. 1 with parts exploded for illustration purposes.

FIG. 3 shows details of the component parts of the connector 1. A flat metal plate 10 is stamped and formed with elongated lands 11, 12, 13 in raised relief. A pair of spaced apart tabs 14, 14 project from one side edge of the plate 10 and are bent to project outwardly of the plane of the plate 10. A similar pair of tabs 15, 15 are on an opposite side edge of the plate. Slotted apertures 16, 16 are provided along end edges of the plate 10 and receive fasteners 17, 17 in the form of machine screws that anchor the plate 10 to an office floor. A cushion pad 18 of insulative material, for example, is constructed to overlie the lands 11, 12, 13.

Figure 5:
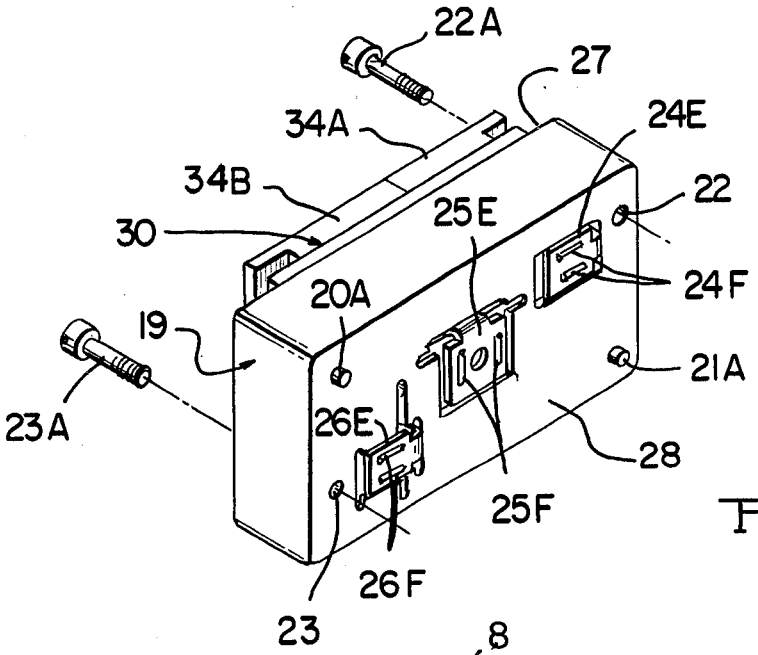
FIG. 5 is a perspective view of a terminal block assembled with the terminals according to FIG. 4.

FIGS. 3 and 5 show a terminal block 19 constructed to overlie the lands 11, 12, 13. The terminal block 19 is molded of insulative plastics and with locking means in the form of projecting feet 20A, 21A that register in apertures 20B, 21B in the raised lands 11, 13 respectively. The feet 20A, 21A lock the terminal block against movement relative to the lands 11, 13. Apertures 22, 23 through the block carry fasteners 22A, 23A in the form of machine screws that secure in apertures 22B, 23B in the raised land 12. The block 19 is provided with three terminal receiving cavities 24, 25, 26 that extend from a first side 27 of the block to a second side 28 from which project the feet 20A, 21A.

Figure 4:
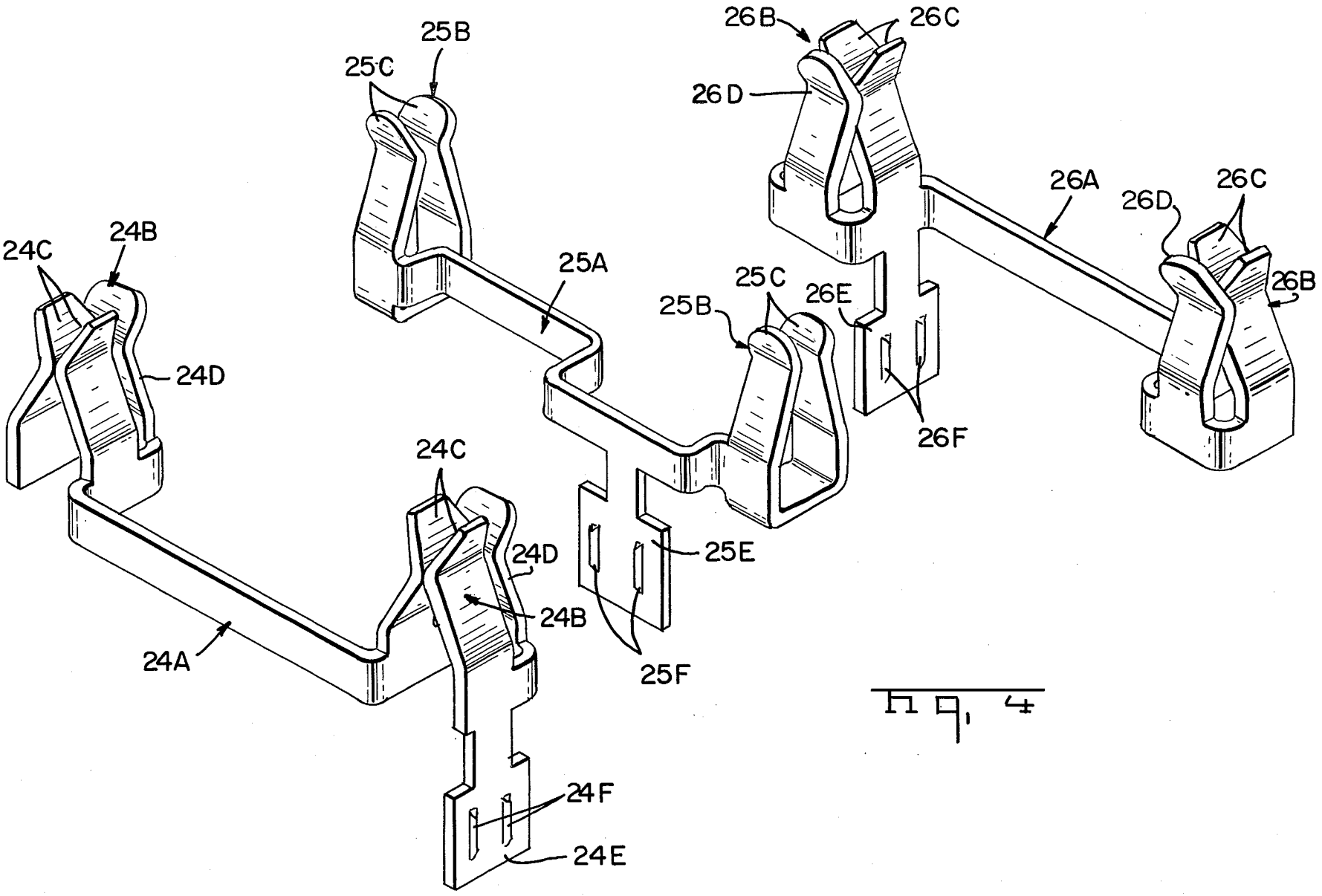
FIG. 4 is a perspective view of three electrical terminals of the connector assembly according to FIG. 1.

FIG. 4 shows electrical terminals 24A, 25A, 26A that are stamped and formed from single pieces of metal strip and are constructed for assembly within the cavities 24, 25, 26 respectively. The terminals 24A and 26A are identical to the extent that they have resilient electrical receptacle portions 24B, 24B, 26B, 26B defined by and between pairs of opposed spring fingers 24C, 24C, 24C, 24C, 26C, 26C, 26C, 26C. Auxiliary fingers 24D, 24D, 26D, 26D, form sides of the electrical receptacles. The terminals 24A, 26A, further include conductor terminating portions 24E, 26E in the form of planar plates with raised in relief, knife edged lances 24F, 24F, 26F, 26F.

The terminal 25A, includes electrical receptacle portions 25B, 25B defined by and between pairs of opposed resilient spring fingers 25C, 25C, 25C, 25C. Terminal 25A further includes a conductor terminating portion 25E in the form of a planar plate having raised in relief knife edged lances 25F, 25F. The terminals 24A, 25A, 26A are assembled in respective cavities 24, 25, 26 of the terminal block 19. The receptacle portions 24B, 24B, 25B, 25B, 26B, 26B remain in the cavities 24, 25, 26 and face toward, and open toward, the first side 27 of the terminal block 19.

Figure 7:
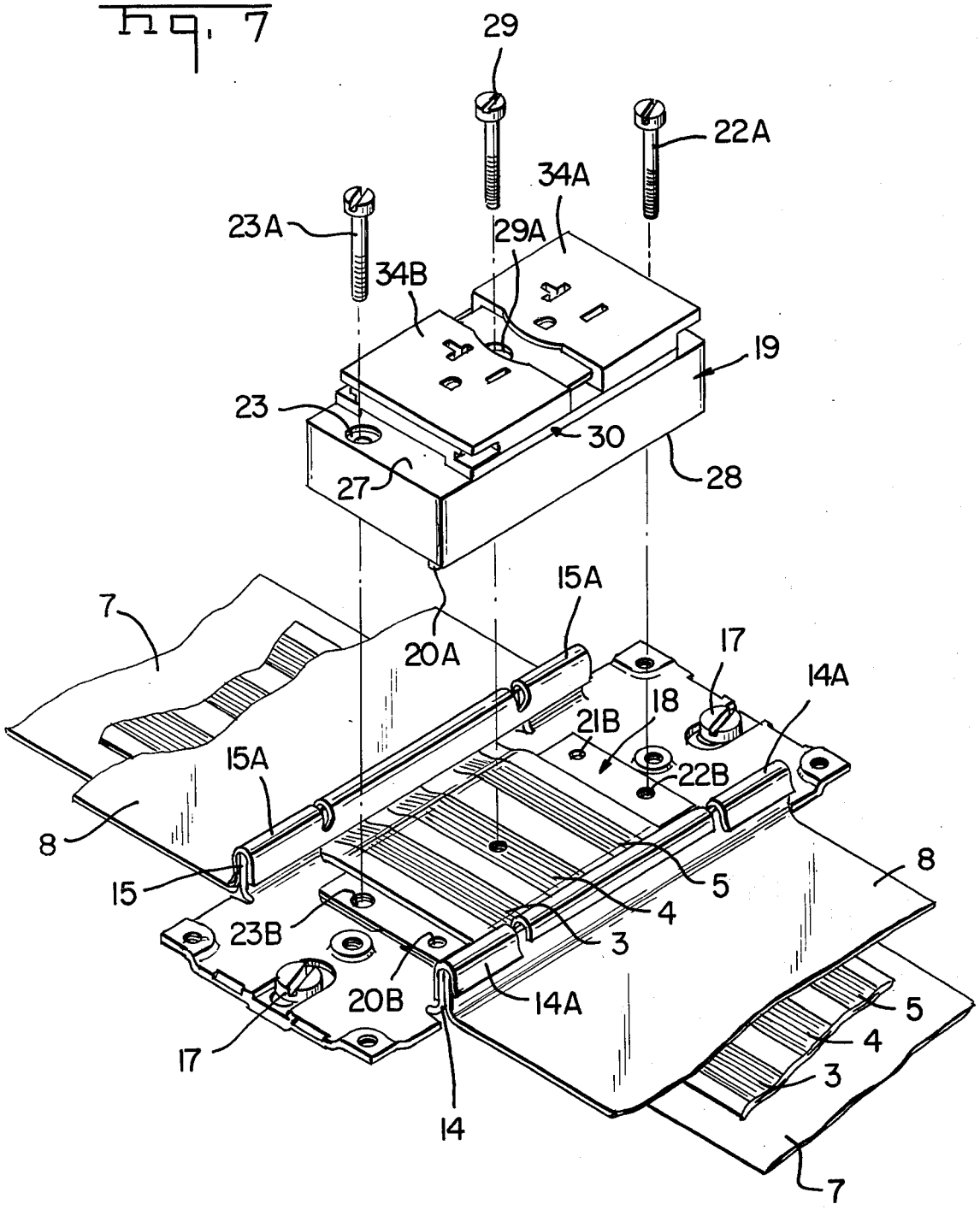
FIGS. 7 and 8 are fragmentary perspective views illustrating component parts during assembly thereof into the connector assembly according to FIG. 1.

Operation of these receptacle portions is well known from the disclosure of U.S. Pat. No. 3,860,739. As shown in FIG. 5, the conductor terminating portions 24E, 25E, 26E emerge from the cavities 24, 25, 26 and are bent to overlie against the second side 28 of the terminal block 19 so that the lances 24F, 24F, 25F, 25F, 26F, 26F face outwardly away from the second side 28 of the terminal block 19. FIGS. 3 and 7 show a conductive fastener 29A in the form of a conductive machine screw carried in a bore 29 of the cover extending from the first side 27 to the second side 28. The conductive fastener 29A is constructed to secure in an aperture 29B in the land 12. A conductive plate 29C has projecting knife edged lances 29D, 29D, and is mounted in a recess 29E in the land 12. The lances 29D, 29D, project through an opening 29E in the pad 18.

FIGS. 3 and 7 show a faceplate 30 of molded plastics and having flanges 31 molded with projecting feet 32 constructed for assembly in apertures 32A in the side 27 of the terminal block 19. The flanges 31 are molded with a raised track 33 having two arrays of profiled apertures 24G, 24G, 25G, 25G, 26G, 26G aligned with the electrical receptacle portions 24B, 24B, 25B, 25B, 26B, 26B and constructed for receipt of an electrical plug (not shown) of the type provided on the electrical cord of a household appliance or office machine. A cover plate is divided into two cover sections 34A, 34B constructed for slidably mounting on the track 33. Wire springs, one shown at 35, mount in each of recesses 36, 36, 36, 36 in the first side 27 of the terminal block 19 and pass through openings 36A, 36A, 36A, 36A in the faceplate 30 and engage respective cover sections 34A, 34B, and bias the cover sections into mutual abutment. The cover sections 34A, 34B each have profiled apertures 24H, 25H, 26H that become aligned with the profiled apertures 24G, 25G, 26G in the faceplate 30 upon slidably positioning the cover sections 34A, 34B along the track 33 in opposition to the springs and in respect to the faceplate 30. The terminal block 19 is assembled with the terminals 24A, 25A, 26A, the faceplate 30, and the cover sections 34A, 34B.

Figure 8:
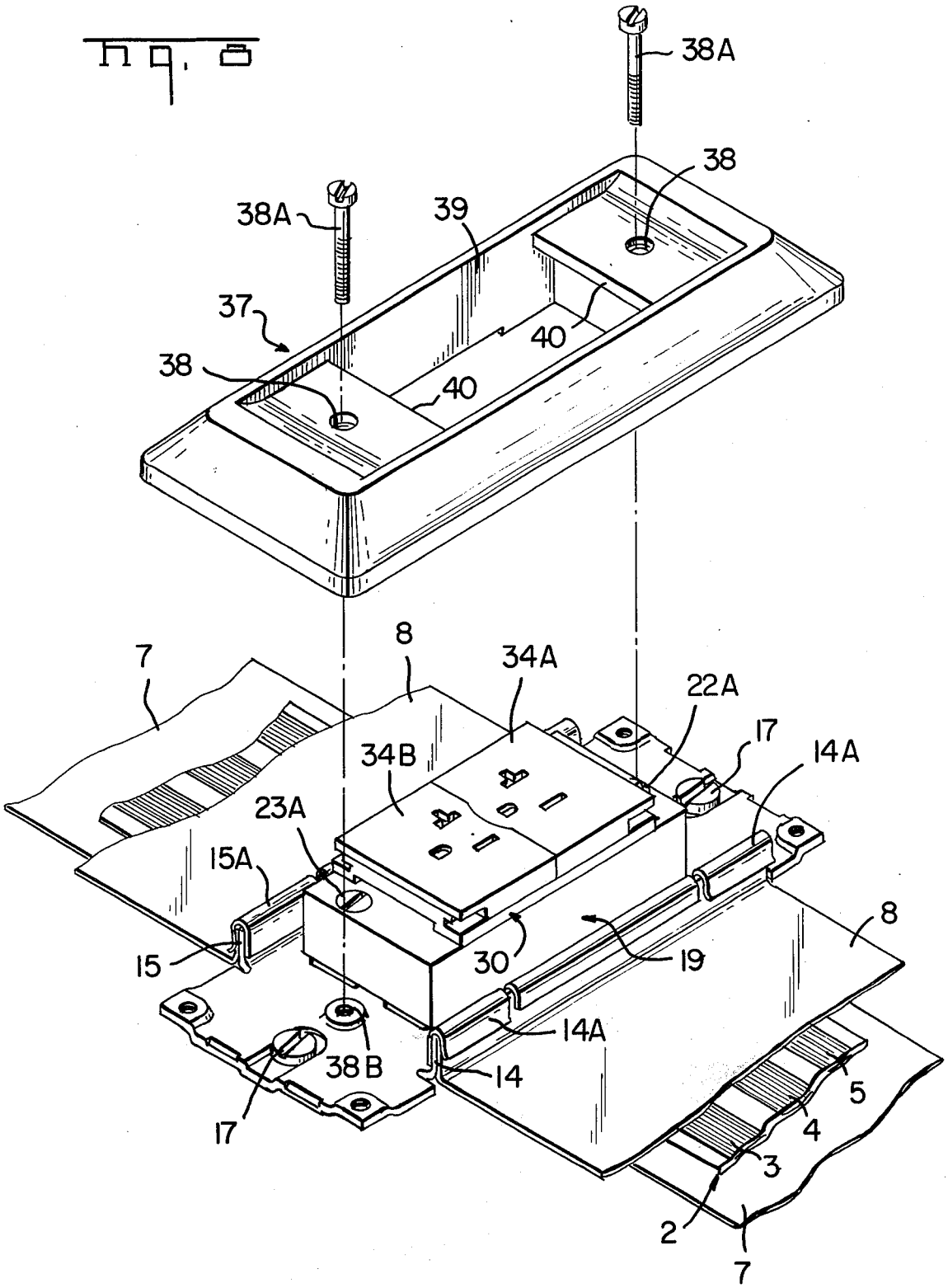

FIGS. 3 and 8 show a cover 37 constructed to cover the plate 10. Fasteners 38A in the form of machine screws are carried in bores 38 of the cover 37 and are constructed to secure in apertured lands 38B that are raised in relief from the plate 10. The cover 37 has a hollow interior 39 constructed to receive the terminal block 19. A top wall 40 surrounding the hollow interior 39 is constructed for mounting against the first side 27 of the terminal block 19 coplanar with the flanges 31 of the faceplate 30.

Figure 6:
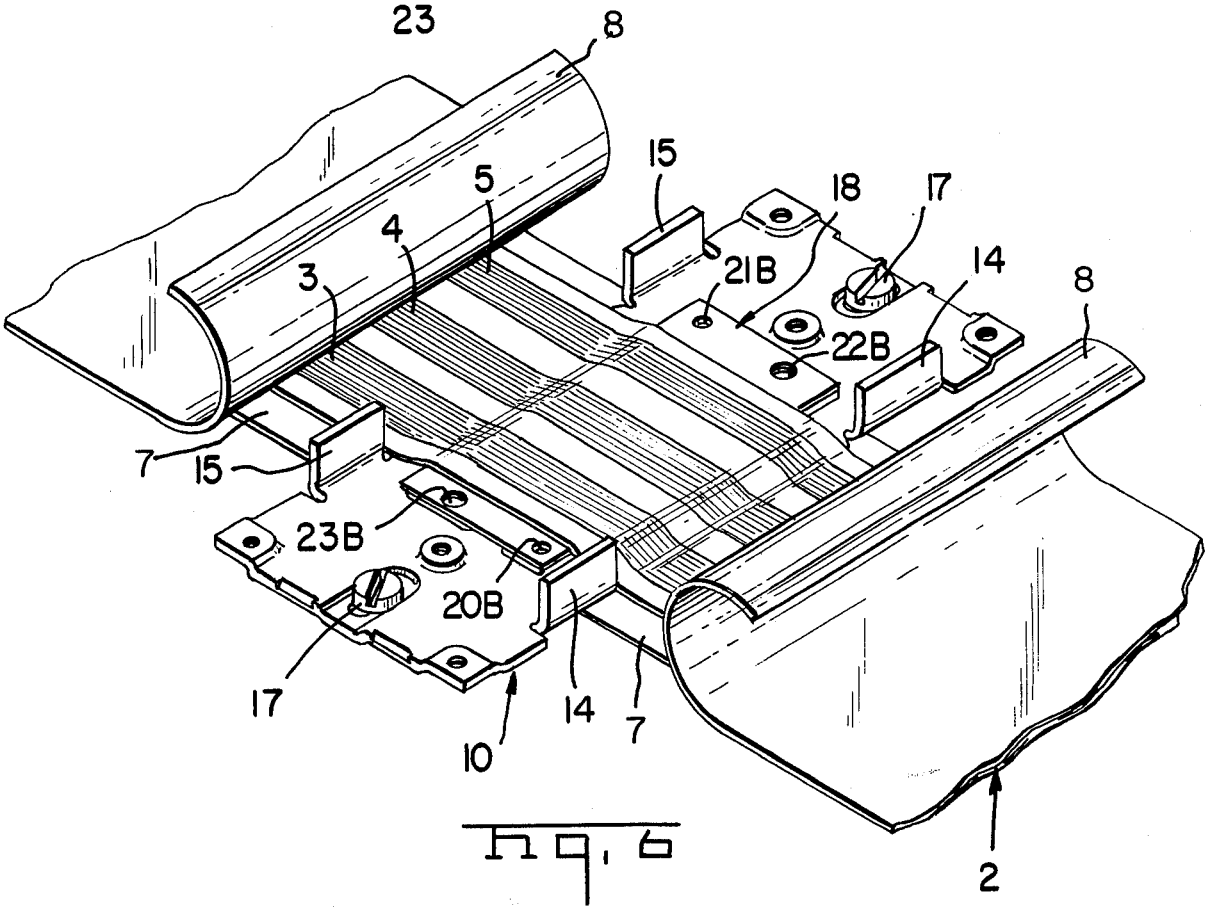
FIG. 6 is a fragmentary perspective view of a plate of the connector assembly and a flat flexible cable in preparation for connection with the connector assembly.

Further details of the assembly are shown in FIG. 6. The cable 2 and the shields 7, 8 are laid against a floor. The shield 8 is severed transversely of its length to expose the cable 2. The plate 10 is assembled between the cable 2 and the shield 7 and is secured by the fasteners 17 to the floor. The elongated lands 11, 12, 13 lie under the conductors 3, 4, 5 while the insulation pad 18 separates and cushions the conductors from the lands 11, 12, 13.

FIG. 7 shows the edges of the shield 8 folded out of the plane of the remainder of the shield 8 to impinge the tabs 14, 15. The edges of the shield 8 are trimmed to the height of the tabs, 14,15. Conductive U-shaped spring clips 14A, 15A clip together the shield 8 and the tabs 14, 15 thereby establishing electrical connections therebetween. The terminal block 19 overlies the lands 11, 12, 13 with the cable conductors 3, 4, 5 interposed. The fasteners 23A, 29A, 22A secure in the lands 11, 12, 13 and mount the block 19 to the plate 10. The conductive fastener 29A secures also into and through the conductor 4, and the plate 29C establishing ground potential electrical connections with the plates 10, 29C, the conductor 4 and the fastener 29A. The conductors 3, 4, 5 are clamped between the block and the lands 11, 12, 13. The conductors conform to the raised edges of the lands and are gripped by the raised lands to prevent their movement. The cushion 18 prevents the raised edges of the lands from penetrating into the cable insulation 6. The block 19 urges the knife edged lances 24F, 24F, 25F, 25F, 26F, 26F, 29D, 29D to penetrate through a layer of the cable insulation 6 and penetrate into respective conductors 3, 4, 5, thereby to establish electrical connections with those conductors and those lances. Thereafter, the cover 37 shown in FIG. 8 is assembled over the terminal block 19, the faceplate 30 and the cover sections 34A and 34B, so that the wall 40 of the cover 37 is coplaner with the flanges 31, 31 of the faceplate 30. The cover sections 34A, 34B are slidably supported on the track 33 that is elevated from the flanges 31, 31 and the wall 40.

Therefore, an object of the invention is to provide an electrical connector for undercarpet flat and flexible cable that includes one or more flat electrical conductors contained in a flexible sheath of insulating material, comprising;

A planar metal plate having a plurality of lands raised in relief,

An insulative terminal block constructed to overlie selected lands of the plate with an undercarpet flat and flexible cable interposed between the block and the selected lands overlaid by the block, Mounting feet projecting from the block and constructed for locked registration with selected lands of the plate, The block having terminal receiving cavities extending from one side of the block to a second side, Electrical terminals in the cavities of the block, the terminals having electrical receptacle portions opening toward the first side of the block and conductor terminating portions emerged from the cavities and overlying against the second side of the block, Lances on the conductor terminating portions, the lances facing outwardly away from the second side of the block, A conductive fastener carried by the block and constructed to mechanically secure in one of the lands overlaid by the block and apply the block and the overlaid lands in clamped relationship on the cable, the block urging the lances of the conductor terminating portions to penetrate through a layer of cable insulation and penetrate into respective flat conductors of the cable, that is interposed between the block and the overlaid lands of the plate, thereby to establish electrical connections between the lances and the respective flat conductors, the conductive fastener constructed further to mechanically secure in one flat conductor of the cable.

A cover having a hollow interior receiving the block therein, and

Fasteners carried by the cover and constructed to secure in selected lands of the plate.

We claim:

1. An electrical connector for undercarpet flat and flexible cable that includes one or more flat electrical conductors contained in a flexible sheath of insulating material, comprising;

a planar metal plate having a plurality of lands raised in relief, an insulative terminal block constructed to overlie selected lands of the plate with an undercarpet flat and flexible cable interposed between the block and the selected lands overlaid by the block, mounting feet projecting from the block and constructed for locked registration with selected lands of the plate, the block having terminal receiving cavities extending from one side of the block to a second side, electrical terminals in the cavities of the block, the terminals having electrical receptacle portions opening toward the first side of the block and conductor terminating portions emerged from the cavities and overlying against the second side of the block, lances on the conductor terminating portions, the lances facing outwardly away from the second side of the block, a conductive fastener carried by the block and constructed to mechanically secure in one of the lands overlaid by the block and apply the block and the overlaid lands in clamped relationship on the cable, the block urging the lances of the conductor terminating portions to penetrate through a layer of cable insulation and penetrate into respective flat conductors of the cable, that is interposed between the block and the overlaid lands of the plate, thereby to establish electrical connections between the lances and the respective flat conductors, the conductive fastener constructed further to mechanically secure in one flat conductor of the cable, a cover having a hollow interior receiving the block therein, and fasteners carried by the cover and constructed to secure in selected lands of the plate.

2. A connector assembly for connecting electrical socket receptacles with corresponding flat conductors of an undercarpet cable comprises:

a base portion and an insulating terminal block structure; the terminal block structure including a first side, a second side, and terminal receiving cavities extending between said sides;

electrical terminals situated in respective cavities in the terminal block; each terminal being stamped and formed with a receptacle portion and a planar plate conductor terminating portion, the receptacle portion opening toward the first side of the block, the terminating portion emerging from the cavity and lying against the second side of the terminal block, the planar plate terminating portion having raised relief lances thereon which face outwardly from second side, said lances penetrating completely through a layer of insulation of the cable and into the flat conductors when said cable is clamped between said second side of said terminal block and the base portion such that the planar plate terminating portions face respective flat conductors in said cable.

3. The electrical connector according to claim 2 and further including a faceplate overlying the first side of the terminal block and having profiled apertures aligned with the cavities in the block and with the electrical receptacle portions of the terminals, two cover sections each slidably mounted on the faceplate, and profiled apertures in each cover section that become aligned with the profiled apertures in the faceplate upon slidably positioning the cover sections in respect to the faceplate.

4. The electrical connector according to claim 2 and further including a plurality of tabs bent outwardly of the place of the base portion, a metal shield which overlies the cable being folded against the tabs, and conductive clips holding together the shield and tabs to establish electrical connections therebetween.

* * * * *